US011021344B2

(12) United States Patent
Finn et al.

(10) Patent No.: US 11,021,344 B2
(45) Date of Patent: Jun. 1, 2021

(54) DEPTH SENSOR AND METHOD OF INTENT DEDUCTION FOR AN ELEVATOR SYSTEM

(71) Applicant: Otis Elevator Company, Farmington, CT (US)

(72) Inventors: Alan Matthew Finn, Hebron, CT (US); Arthur Hsu, South Glastonbury, CT (US); Hui Fang, Shanghai (CN); Zhen Jia, Shanghai (CN)

(73) Assignees: OTIS ELEVATOR COMPANY, Farmington, CT (US); UNITED TECHNOLOGIES RESEARCH CENTER (CHINA) LTD., Shanghai (CN)

( * ) Notice: Subject to any disclaimer, the term of this patent is extended or adjusted under 35 U.S.C. 154(b) by 496 days.

(21) Appl. No.: 15/968,477

(22) Filed: May 1, 2018

(65) Prior Publication Data

US 2018/0334357 A1 Nov. 22, 2018

(30) Foreign Application Priority Data

May 19, 2017 (CN) ..... 201710361335.X

(51) Int. Cl.
*B66B 1/46* (2006.01)
*B66B 1/24* (2006.01)
(Continued)

(52) U.S. Cl.
CPC ..... *B66B 1/468* (2013.01); *B66B 1/2408* (2013.01); *B66B 1/3476* (2013.01);
(Continued)

(58) Field of Classification Search
CPC ..... B66B 1/468; B66B 1/3476; B66B 1/2408; B66B 5/0012; B66B 2201/00;
(Continued)

(56) References Cited

U.S. PATENT DOCUMENTS 6,209,685 B1 4/2001 Zaharia et al.
8,473,420 B2 6/2013 Bonus et al.
(Continued)

FOREIGN PATENT DOCUMENTS

CN 103261068 A 8/2013
JP 2014136624 A 7/2014
WO 2016100293 A1 6/2016

OTHER PUBLICATIONS

McFarland, "One day an elevator might ask—Are you getting on?", The Washington Post—Innovations, Jan. 22, 2014, XP055204831, Retrieved from the Internet: URL:http://www.washingtonpost.com/blogs/innovation/wp/2014/01/22/one-day-an-elevator-might-ask-are-you-getting-on/[retrieved on Jul. 27, 2015], 11 pages.
(Continued)

*Primary Examiner* — Jeffrey Donels
(74) *Attorney, Agent, or Firm* — Cantor Colburn LLP

(57) ABSTRACT

An elevator system is provided and includes a sensor assembly and a controller. The sensor assembly is disposable in or proximate to an elevator lobby and is configured to deduce an intent of an individual in the elevator lobby to board one of one or more elevators and to issue a call signal in response to deducing the intent of the individual to board the one of the elevators. The controller is configured to receive the call signal issued by the sensor assembly and to assign one or more of the elevators to serve the call signal at the elevator lobby.

17 Claims, 6 Drawing Sheets

(51) Int. Cl.
*B66B 5/00* (2006.01)
*B66B 1/34* (2006.01)

(52) U.S. Cl.
CPC ..... *B66B 5/0012* (2013.01); *B66B 2201/00* (2013.01); *B66B 2201/4638* (2013.01)

(58) Field of Classification Search
CPC . B66B 2201/4638; B66B 1/3407; B66B 1/46; B66B 5/0037
See application file for complete search history.

(56) References Cited

U.S. PATENT DOCUMENTS

| | | | | |
|---|---|---|---|---|
| 9,081,413 | B2 | 7/2015 | Wu et al. | |
| 2006/0187037 | A1 | 8/2006 | Eubelen et al. | |
| 2010/0277579 | A1 | 11/2010 | Cho et al. | |
| 2012/0305341 | A1 | 12/2012 | Kuoppala et al. | |
| 2016/0161339 | A1 | 6/2016 | Tan | |
| 2016/0289042 | A1* | 10/2016 | Fang | G06T 7/10 |
| 2016/0289043 | A1 | 10/2016 | Fang et al. | |
| 2016/0289044 | A1 | 10/2016 | Hsu et al. | |
| 2016/0292515 | A1 | 10/2016 | Jia et al. | |
| 2016/0295192 | A1 | 10/2016 | Hsu et al. | |
| 2016/0347577 | A1 | 12/2016 | Simcik et al. | |
| 2018/0052519 | A1* | 2/2018 | Amores-Llopis | G06F 3/011 |
| 2018/0052520 | A1* | 2/2018 | Amores Llopis | G06F 3/017 |
| 2018/0074466 | A1* | 3/2018 | Witczak | B66B 1/468 |

OTHER PUBLICATIONS

Search Report dated Dec. 3, 2018 in U320871EP, EP Application No. EP18173243, 10 pages.
Erden et al., "Human-Intent Detection and Physically Interactive Control of a Robot Without Force Sensors", IEEE Transactions on Robotics, 2010.
Kelgeorgiadis et al., "Human Action Recognition in 3D Motion Sequences", Artificial Intelligence and Information Analysis Laboratory, Department of Informatics, Aristotle University of Thessaloniki , Thessaloniki, Greece, 2014, 5 pages.
Moeslund et al., "A Survey of Advances in Vision-Based Human Motion Capture and Analysis", Elsevier Science, 2006, 78 pages.
Nakauchi et al., "Human Intention Detection and Activity Support System for Ubiquitous Sensor Room", 2004, 8 pages.
Pei et al., "Human Behavior Cognition Using Smartphone Sensors", Sensors, 2013, pp. 1402-1424.
Li "3D TOF occupancy detection: body tracking and people counting", URL:<https://training.ti.com/3d-tof-occupancy-detection-body-tracking-and-people-counting>, Sep. 23, 2016, 2 pages.

* cited by examiner

DEPTH SENSOR AND METHOD OF INTENT DEDUCTION FOR AN ELEVATOR SYSTEM

CROSS REFERENCE TO RELATED APPLICATION

This patent application claims priority to Chinese Patent Application Serial No. 201710361335.X filed May 19, 2017, which is incorporated herein by reference in its entirety.

BACKGROUND

The following description relates to elevator systems and, more particularly, to a depth sensor and method of intent deduction for use with an elevator system.

Elevator systems that call elevators automatically are available. However, these systems may make elevator calls even though the individuals might not actually want to board the elevators. This is due to the fact that those individuals might be standing in or proximate to the elevator lobby for reasons other than getting ready to board an elevator. They may be waiting for someone or simply resting. Similarly, an individual might walk toward an elevator lobby simply to avoid bumping into someone else. Whatever the case may be, when an elevator call is made for an individual who does not actually want to board the elevator, the elevator system wastes energy and power and might delay an elevator call for another individual who does in fact want to board.

BRIEF DESCRIPTION

According to one aspect of the disclosure, an elevator system is provided and includes a sensor assembly and a controller. The sensor assembly is disposable in or proximate to an elevator lobby and is configured to deduce an intent of an individual in the elevator lobby to board one of one or more elevators and to issue a call signal in response to deducing the intent of the individual to board the one of the elevators. The controller is configured to receive the call signal issued by the sensor assembly and to assign one or more of the elevators to serve the call signal at the elevator lobby.

In accordance with additional or alternative embodiments, the sensor assembly is configured to sense one or more of multiple cues and contextual incidences relating to the individual.

In accordance with additional or alternative embodiments, the sensor assembly is configured to sense one or more of multiple cues and contextual incidences relating to the individual and to compare the one or more of multiple cues and contextual incidences with historical data to deduce the intent.

In accordance with additional or alternative embodiments, the sensor assembly is configured to sense one or more of the individual's body orientation, head pose, gaze direction, motion history, clustering with other individuals and vocals to deduce the intent.

In accordance with additional or alternative embodiments, the sensor assembly is configured to sense one or more of the individual's body orientation, head pose, gaze direction, motion history, clustering with other individuals and vocals and to compare the one or more of the individual's body orientation, head pose, gaze direction, motion history, clustering with other individuals and vocals with historical data to deduce the intent.

In accordance with additional or alternative embodiments, the sensor assembly includes a depth sensor.

According to another aspect of the disclosure, an elevator system is provided. The elevator system includes a sensor assembly and a controller. The sensor assembly is disposable in or proximate to an elevator lobby and is configured to deduce an intent of at least one of multiple individuals in the elevator lobby to board a particular one of multiple elevators and to issue a call signal accordingly. The controller is configured to receive the call signal issued by the sensor assembly and to assign the particular one or more of the multiple elevators to serve the call signal at the elevator lobby.

In accordance with additional or alternative embodiments, the sensor assembly is configured to sense one or more of multiple cues and contextual incidences relating to each of the multiple individuals and a grouping thereof.

In accordance with additional or alternative embodiments, the sensor assembly is configured to sense one or more of multiple cues and contextual incidences relating to each of the multiple individuals and a grouping thereof and to compare the one or more of multiple cues and contextual incidences with historical data to deduce the intent.

In accordance with additional or alternative embodiments, the sensor assembly is further configured to sense a group behavior of the multiple individuals and to compare the group behavior with historical data to deduce the intent.

In accordance with additional or alternative embodiments, the sensor assembly is configured to sense one or more of each individual's body orientation, head pose, gaze direction, motion history, clustering with other individuals and vocals to deduce the intent.

In accordance with additional or alternative embodiments, the sensor assembly is configured to sense one or more of each individual's body orientation, head pose, gaze direction, motion history, clustering with other individuals and vocals and to compare the one or more of the individual's body orientation, head pose, gaze direction, motion history, clustering with other individuals and vocals with historical data to deduce the intent.

In accordance with additional or alternative embodiments, the sensor assembly is further configured to sense a group behavior of the multiple individuals and to compare the group behavior with historical data to deduce the intent.

In accordance with additional or alternative embodiments, the sensor assembly includes a depth sensor.

According to yet another aspect of the disclosure, a method of operating a sensor assembly of an elevator system is provided. The method includes deducing an intent of an individual in an elevator lobby to board an elevator of the elevator system and issuing a call signal for bringing the elevator to the elevator lobby in accordance with the intent of the individual to board the elevator being deduced.

In accordance with additional or alternative embodiments, the deducing includes sensing one or more of multiple cues and contextual incidences relating to the individual.

In accordance with additional or alternative embodiments, the deducing includes sensing one or more of multiple cues and contextual incidences relating to the individual and comparing the one or more of multiple cues and contextual incidences with historical data.

In accordance with additional or alternative embodiments, the deducing includes sensing one or more of the individual's body orientation, head pose, gaze direction, motion history, clustering with other individuals and vocals.

In accordance with additional or alternative embodiments, the deducing includes sensing one or more of the individual's body orientation, head pose, gaze direction, motion history, clustering with other individuals, elevator data and vocals and comparing the one or more of the individual's body orientation, head pose, gaze direction, motion history, clustering with other individuals and vocals with historical data.

In accordance with additional or alternative embodiments, the deducing includes deducing an intent of one of multiple individuals in the elevator lobby to board an elevator of the elevator system and issuing a call signal for bringing the elevator to the elevator lobby in accordance with the intent of the one of the multiple individuals to board the elevator being deduced.

These and other advantages and features will become more apparent from the following description taken in conjunction with the drawings.

BRIEF DESCRIPTION OF THE DRAWINGS

The subject matter, which is regarded as the disclosure, is particularly pointed out and distinctly claimed in the claims at the conclusion of the specification. The foregoing and other features, and advantages of the disclosure are apparent from the following detailed description taken in conjunction with the accompanying drawings in which:

DETAILED DESCRIPTION

As will be described below, a system is provided for distinguishing between a person who is approaching elevators doors with the intent to board an elevator from another person who is merely passing or standing near the elevator doors. The system employs a 3D depth sensor that uses one or more of cues and contextual incidents such as body orientations, head poses, gaze directions, motion histories, clustering of individuals, elevator data, voice recognition, group behavior analyses and activity recognition to deduce a person's or a group's intent for elevator usage.

Figure 1:
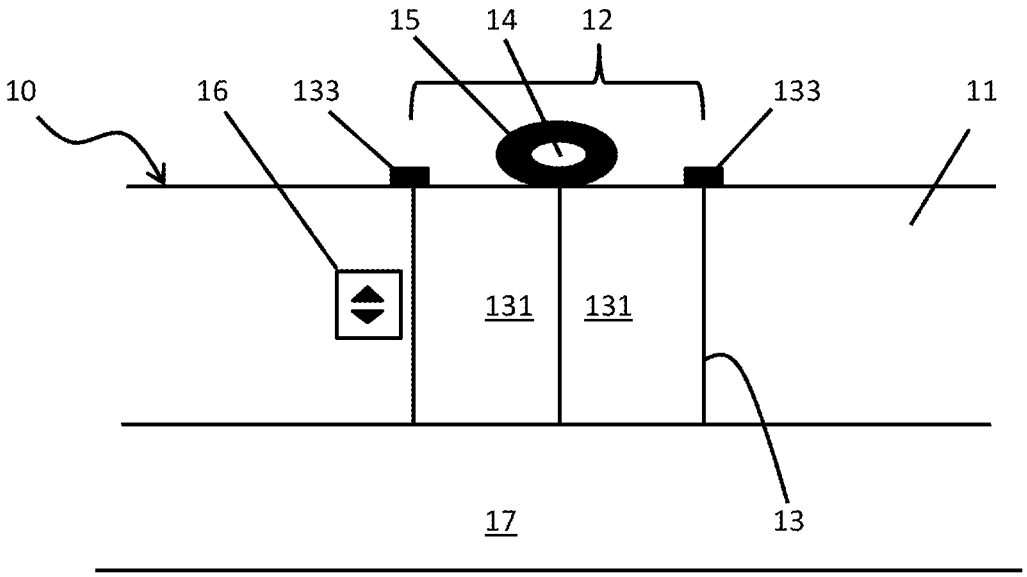
FIG. 1 is an elevational view of an elevator system in accordance with embodiments.

With reference to FIG. 1, an elevator system 10 is provided. The elevator system 10 includes a wall 11 that is formed to define an aperture 12, a door assembly 13, a sensor assembly 14, a controller 15, an elevator call button panel 16 and an elevator lobby 7. The door assembly 13 that may be provided is operable to assume an open position at which the aperture 12 is opened and entry or exit to or from an elevator is permitted and a closed position at which the aperture 12 is closed to prevent entry or exit from the elevator. It is to be understood that the door assembly 13 can only safely assume the open position when an elevator has been called (with the notable exception of service being done on the elevator system 10) and has arrived at the aperture 12. As such, and for additional reasons as well, the door assembly 13 is generally configured to normally assume the closed position and to only open when the elevator is appropriately positioned.

The exemplary door assembly 13 may include at least one or more doors 131 and a motor 133 to drive sliding movements of the one or more doors 131 when the elevator is appropriately positioned.

The sensor assembly 14 may be provided as one or more sensors or one or more types. In one embodiment, the sensor assembly 14 may include a depth sensor. Various 3D depth sensing sensor technologies and devices that can be used in sensor assembly 14 include, but are not limited to, a structured light measurement, phase shift measurement, time of flight measurement, stereo triangulation device, sheet of light triangulation device, light field cameras, coded aperture cameras, computational imaging techniques, simultaneous localization and mapping (SLAM), imaging radar, imaging sonar, echolocation, laser radar, scanning light detection and ranging (LIDAR), flash LIDAR or a combination thereof. Different technologies can include active (transmitting and receiving a signal) or passive (only receiving a signal) sensing and may operate in a band of the electromagnetic or acoustic spectrum such as visual, infrared, ultrasonic, etc. In various embodiments, a depth sensor may be operable to produce depth from defocus, a focal stack of images, or structure from motion. In other embodiments, the sensor assembly 14 may include other sensors and sensing modalities such as a 2D imaging sensor (e.g., a conventional video camera, an ultraviolet camera, and infrared camera, and the like), a motion sensor, such as a PIR sensor, a microphone or an array of microphones, a button or set of buttons, a switch or set of switches, a keyboard, a touchscreen, an RFID reader, a capacitive sensor, a wireless beacon sensor, a cellular phone sensor, a GPS transponder, a pressure sensitive floor mat, a gravity gradiometer or any other known sensor or system designed for person detection and/or intent recognition as described. It may be advantageous that any of these sensors operate in a high dynamic range (e.g., by encoding a transmitted signal and decoding a returned signal by correlation).

Figure 2:
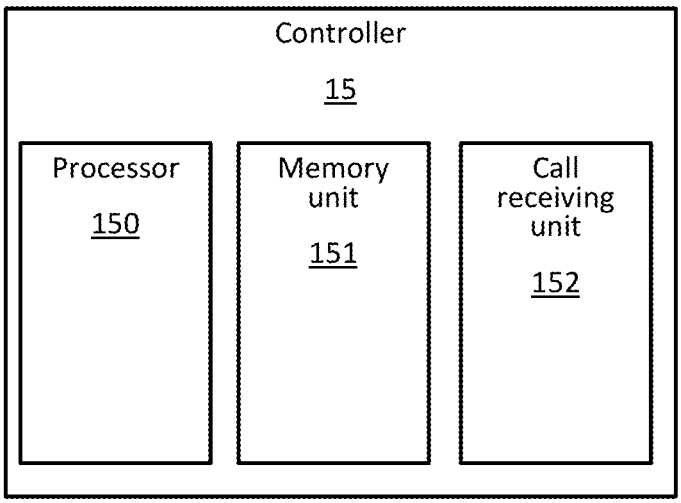
FIG. 2 is a schematic illustration of a processor of the elevator system of FIG. 1.

With reference to FIG. 2, the controller 15 may be provided as a component of the sensor assembly 14 and is configured to receive a call signal that is used to call or bring the elevator to the elevator lobby 17. To this end, the controller 15 may include a processor 150 such as a central processing unit (CPU), a memory unit 151 which may include one or both of read-only and random access memory and a call receiving unit 152. During operations of the elevator system 10, executable program instructions stored in the memory unit 151 are executed by the processor 150 which in turn supports the call receiving unit 152 in receiving the call signal (which is issued by the sensor assembly and the processor 150 in accordance with only those readings generated by the sensor assembly 14 that are determined to be indicative of an individual (or a group of individuals) in the elevator lobby 17 intending to board the elevator and/or in accordance with the elevator call button panel 16 being actuated).

That is, for cases where the elevator call button panel 16 has not been actuated, the sensor assembly 14 and the processor 150 are configured to sense and to process one or more of multiple cues and contextual incidences relating to the individual in the elevator lobby 17 (or each of the multiple individuals and a grouping thereof in the case of multiple individuals in the elevator lobby 17). More particularly, for cases where the elevator call button panel 16 has not been actuated, the sensor assembly 14 and the processor 150 are configured to sense and to process one or more of an individual's body orientation, head pose, gaze direction, motion history, clustering with other individuals, elevator data and vocals and to compare the one or more of the individual's body orientation, head pose, gaze direction, motion history, clustering with other individuals, elevator data and vocals with historical data to deduce the intent. For example, if an individual's gaze direction is generally facing toward elevator floor numbers, that could be recognized as an indication of an intent to wait in the elevator lobby 17 to board a next arriving elevator). If this individual is fidgety, that could also be understood as an indication of a lack of patience for the elevator. In addition, for the particular cases in which a group of multiple individuals are in the elevator lobby 17, the sensor assembly 14 and the processor 150 are further configured to sense and to process a group behavior of the multiple individuals and to compare the group behavior with historical data to deduce the intent of individuals in the group. That is, as another example, a queuing of individuals in the elevator lobby 17 in front of an elevator could be recognized as an intent for each individual in the group to board an elevator.

The elevator data may include, for instance, the location of elevator doors 131 and lobby 17 with respect to the sensor assembly 14. The historical data may be represented by actual measurements made in the building containing elevator system 10 or actual measurements from one or more other buildings containing one or more different elevator systems. The historical data may also include anecdotal observations, personal experience, specified desired elevator system behavior and the like.

Figure 3A:
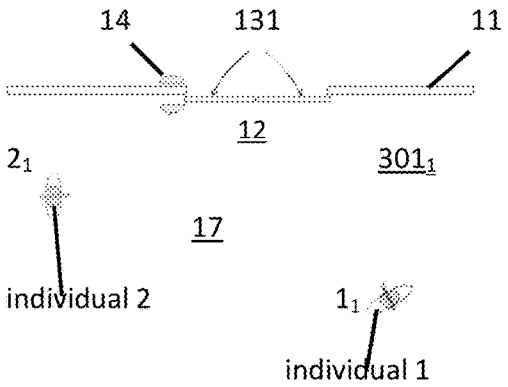
FIG. 3A is a spatial map generated by a processor of a controller and a sensor assembly of the elevator system of FIG. 1.
Figure 3B:
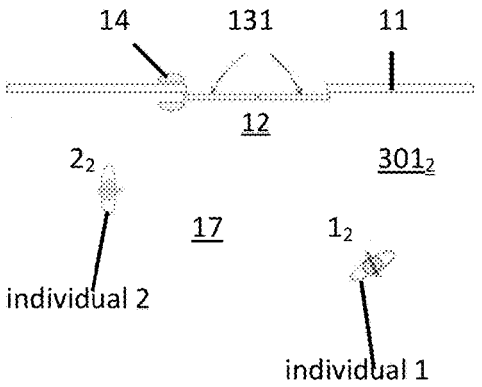
FIG. 3B is a spatial map generated by a processor of a controller and a sensor assembly of the elevator system of FIG. 1.
Figure 3C:
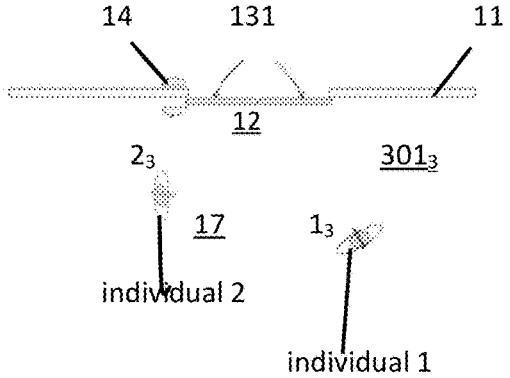
FIG. 3C is a spatial map generated by a processor of a controller and a sensor assembly of the elevator system of FIG. 1.
Figure 3D:
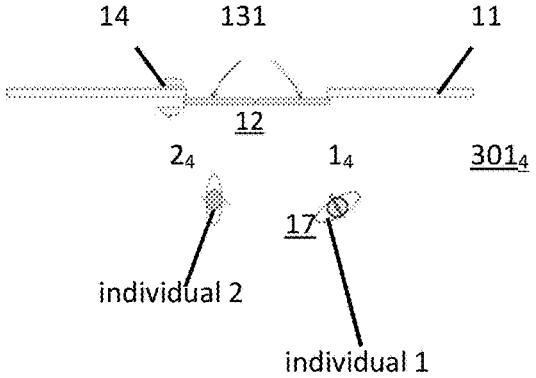
FIG. 3D is a spatial map generated by a processor of a controller and a sensor assembly of the elevator system of FIG. 1.
Figure 4:
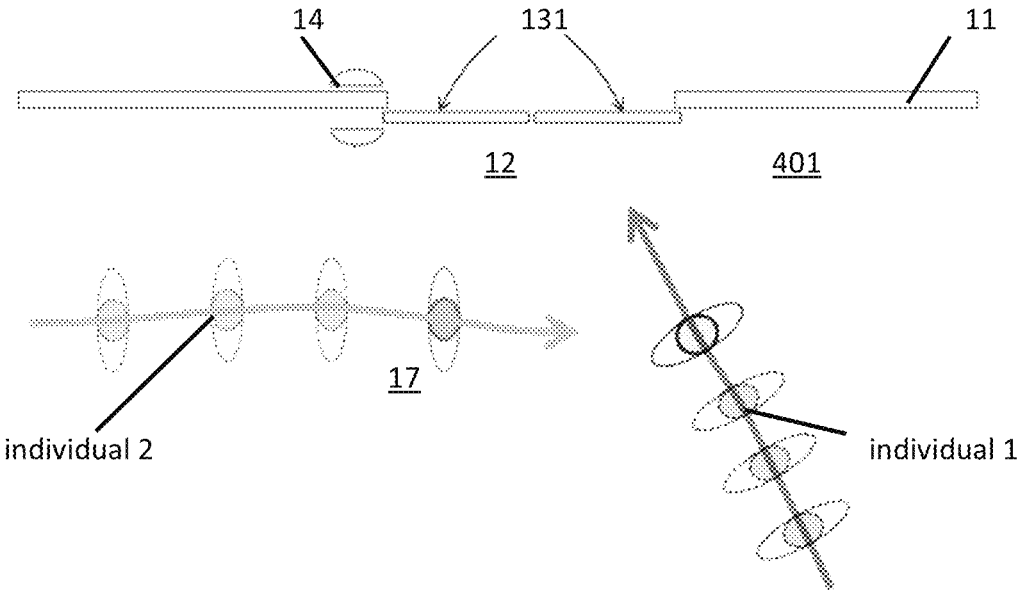
FIG. 4 is comprehensive spatial map generated by the processor and a sensor assembly of the controller of the elevator system of FIG. 1.

With reference to FIGS. 3A-D and FIG. 4, the sensing and the processing may proceed at least partially by the generation of a time series of spatial maps $\mathbf{301}_{1\text{-}4}$ which can be superimposed on one another in a comprehensive spatial map 401 for individuals in or proximate to the aperture 12 of the elevator system 10 such that the individuals can be tracked based on the series of spatial maps $\mathbf{501}_{1\text{-}4}$ (while the comprehensive spatial map 401 in FIG. 4 is illustrated as being provided for two individuals, this is being done for clarity and brevity and it is to be understood that the individuals can be tracked separately in respective comprehensive spatial maps). Thus, as shown in FIG. 3A, spatial map $\mathbf{301}_1$ indicates that individual 1 is in a first position $\mathbf{1}_1$ relative to the aperture 12 and that individual 2 is in a first position $\mathbf{2}_1$ relative to the aperture 12, as shown in FIG. 3B, spatial map $\mathbf{301}_2$ indicates that individual 1 is in a second position $\mathbf{1}_2$ relative to the aperture 12 and that individual 2 is in a second position $\mathbf{2}_2$ relative to the aperture 12, as shown in FIG. 3C, spatial map $\mathbf{301}_3$ indicates that individual 1 is in a third position $\mathbf{1}_3$ relative to the aperture 12 and that individual 2 is in a third position $\mathbf{2}_3$ relative to the aperture 12 and, as shown in FIG. 3D, spatial map $\mathbf{301}_4$ indicates that individual 1 is in a fourth position $\mathbf{1}_4$ relative to the aperture 12 and that individual 2 is in a fourth position $\mathbf{2}_4$ relative to the aperture 12.

Therefore, comprehensive spatial map 401, which includes the indications of each of the spatial maps $\mathbf{301}_{1\text{-}4}$, illustrates that from the tracking of individuals 1 and 2 across the spatial maps $\mathbf{301}_{1\text{-}4}$, it can be determined that individual 1 is likely approaching the aperture 12 and that individual 2 is likely to be walking past the aperture 12 (again, it is noted that the comprehensive spatial map 401 need not be provided for tracking individuals 1 and 2 and that other embodiments exist in which individuals 1 and 2 are tracked separately). With such determinations having been made, the processor 150 may determine that individual 1 intends to board an elevator and thus the call signal can be selectively issued.

The tracking may be accomplished by detection and tracking processes such as background subtraction, morphological filtering, and a Bayesian Filtering method executable by devices such as a Kalman Filter or a Particle Filter. Background subtraction to produce foreground object(s) may be achieved by a Gaussian Mixture Model, a Codebook Algorithm, Principal Component Analysis (PCA) and the like. Morphological filtering may be a size filter to discard foreground object(s) that are not persons (e.g., are too small, have an inappropriate aspect ratio and the like). A Bayesian Filter may be used to estimate the state of a filtered foreground object where the state may be position, velocity, acceleration and the like.

With the elevator being called for individual 1, individual 2 can decide to enter the elevator with the individual 1 even if that wasn't his prior intent. In addition, individual 1 might not end up boarding the elevator because he wasn't actually intending to do so but was instead simply trying to avoid bumping into someone or merely walking aimlessly or if individual 1 changes his mind about boarding the elevator after the call is made. In any case, the actions of individuals 1 and 2 following the elevator call being made can be sensed and tracked and recorded as historical data. As such, when those or other individuals in the elevator lobby 17 take similar tracks, the determinations of whether or not to have the call generating unit selectively issue the call signal can take into account the pre- and post-call actions of individuals 1 and 2 and thereby improve the chance that the ultimate determinations will be correct.

Another use case is when a passenger is already "offered" an elevator but did not board. Here, the passenger had ample opportunity to board (assuming the car wasn't too full) but did not and is thus exhibiting loitering behavior. Usually, in a case like this, it would not make sense to send another car for the passenger as he continues to wait and is apparently just loitering.

While the examples given above address the use of historical data, it is to be noted that the historical data need not be gleaned solely from a local or particular elevator system. Rather, historical data could be gathered from other elevator systems, such as those with similar elevator lobby configurations. As such, intent deduction logic could be trained from those other elevator systems (ideally, a large number of instances) and then used for similar learning in still other elevator systems. In any case, each elevator system can continue to refine its own intent logic (e.g., there may be behaviors specific to the given elevator bay, such as avoiding a large cactus).

Figure 5:
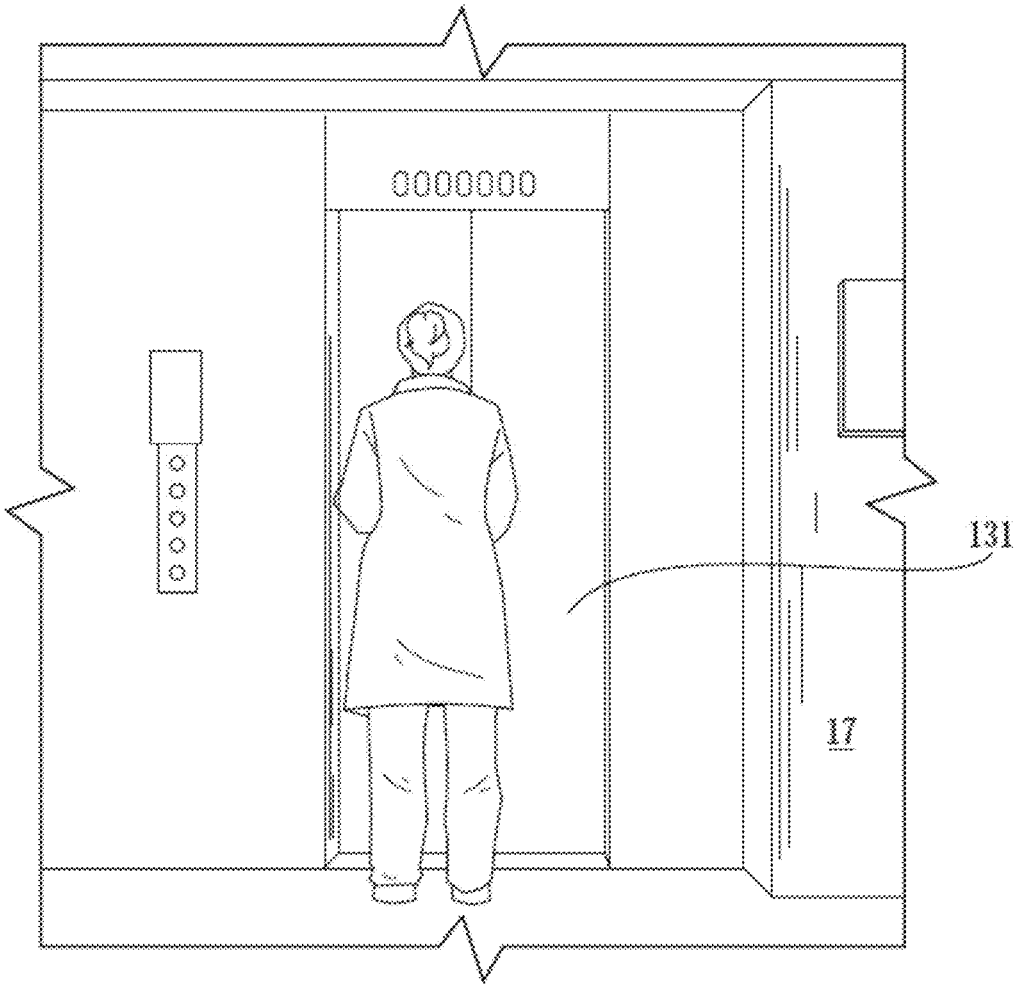
FIG. 5 is an example of an individual standing in an elevator lobby with an intent to board an elevator.
Figure 6:
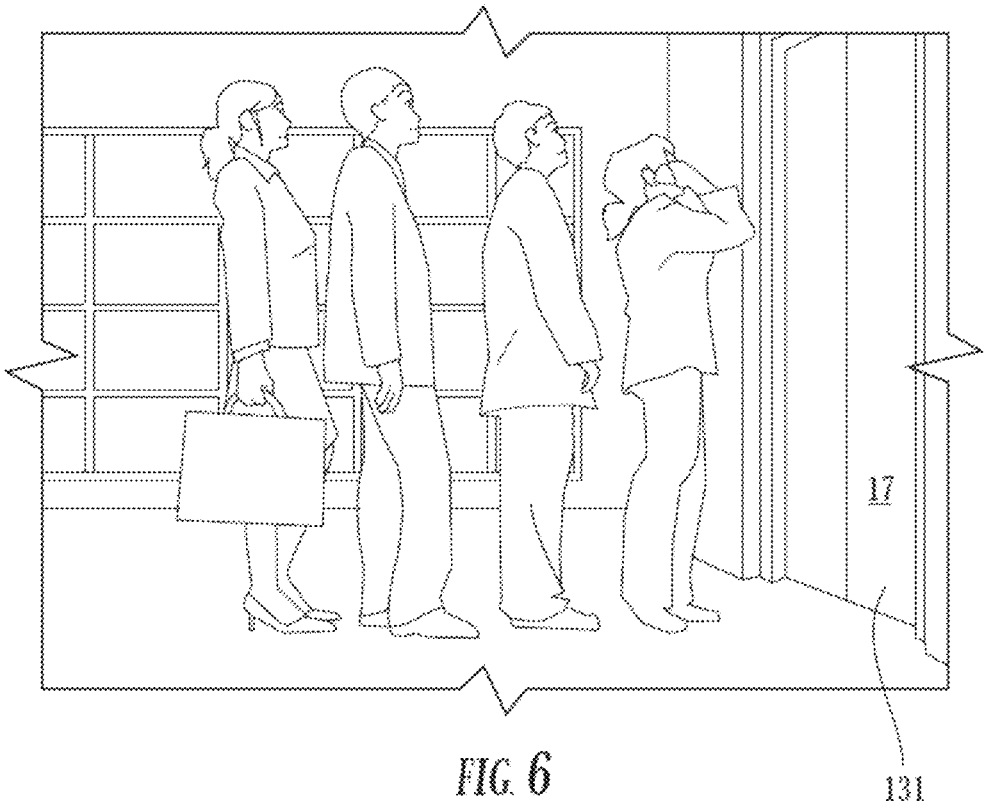
FIG. 6 is an example of a group of individuals standing in an elevator lobby with intent to board an elevator.
Figure 7:
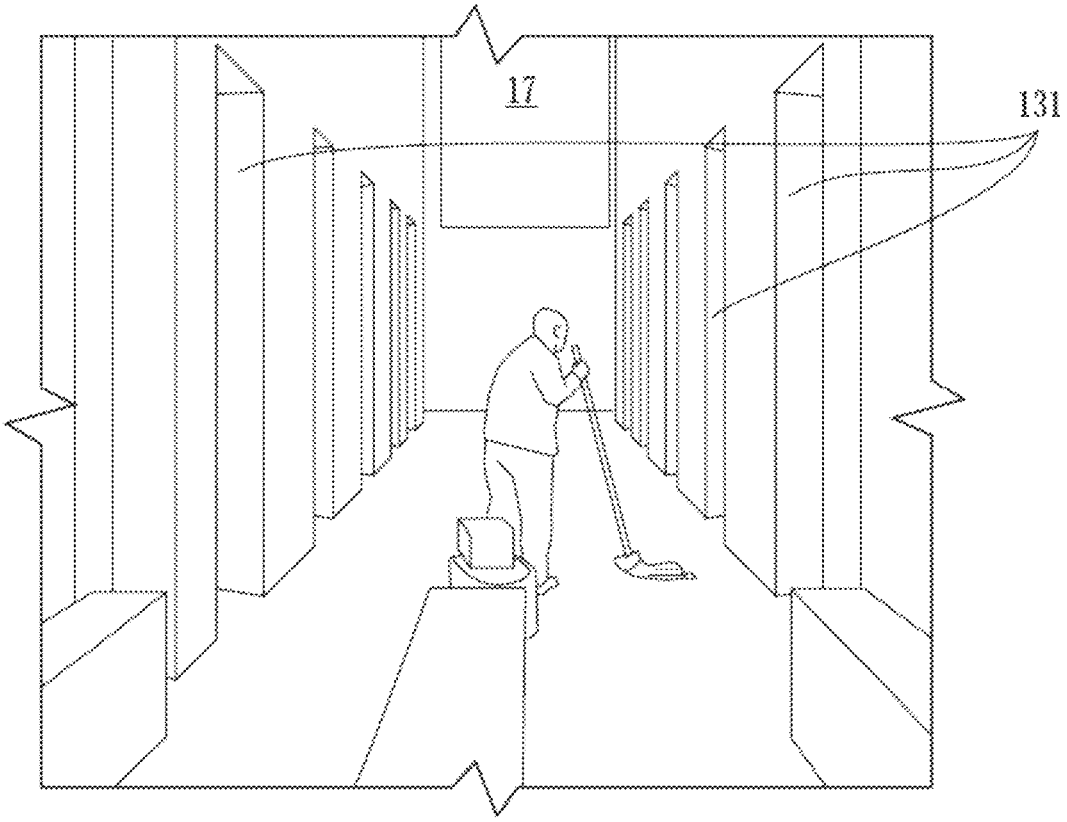
FIG. 7 is an example of an individual cleaning an elevator lobby with no intent to board an elevator.

With reference to FIGS. 5-7, while the sensor assembly 14 and the processor 150 can use the movement of individuals in the elevator lobby 17 to make partial determinations and deductions of intent, it is to be understood that many other cues and contextual incidences can and should be used as well. For example, as shown in FIG. 5, an individual standing still near elevator doors 131 and staring at the update lights signals his intent to board an elevator even if he has chosen not to or forgotten to actuate the elevator call button panel 16. If that individual is tapping his foot or fidgety, that could signal his impatience and need to get to his destination fast. Similarly, as shown in FIG. 6, where multiple individuals are grouped together in a line in the elevator lobby 17 and some are staring at the update lights while others are discussing how long the elevator wait is or what floor they are going to, at least one (probably all) of those individuals will be signaling their intent to board an elevator. If all the individuals in the group are signaling an intent to board, multiple elevators may need to be dispatched to address the apparent needs of the crowd. Therefore, the call signal (or multiple call signals) will be issued for the cases of FIGS. 5 and 6.

On the other hand, however, an individual who is cleaning up the elevator lobby 17 (e.g., by the system recognizing that his actions are consistent with sweeping or mopping duties) and looking down will be sensed but will be understood to be signaling no intent to board an elevator. Therefore, for the case of FIG. 7, no call signal will be issued. Furthermore, the system can learn over time that an individual performing certain activities (in this example, mopping a floor) is unlikely to be intending to board an elevator and thus can make call decisions based on activity recognition.

The use of multiple cues and contextual incidents is more accurate for deducing intent than relying solely on proximity or trajectory of individual(s) in the elevator lobby 17. In accordance with embodiments, it is to be understood that this can be accomplished by the sensor assembly 14 and the controller 15 using multiple features alone or in combination. For example, such multiple features may include data fusion methods (e.g., Deep Learning or Bayesian inference) and motion history understanding from finite state machine (FSM) algorithms. According to one or more embodiments, background subtraction, morphological filtering and a Bayesian Filtering method can be executed by devices such as a Kalman Filter or a Particle Filter to aid in the sensing and tracking of individuals. Background subtraction to produce foreground object(s) may be achieved by a Gaussian Mixture Model, a Codebook Algorithm, Principal Component Analysis (PCA) and the like. Morphological filtering may be a size filter to discard foreground object(s) that are not persons (e.g., they are too small, have an inappropriate aspect ratio and the like). A Bayesian Filter may be used to estimate the state of a filtered foreground object where the state may be position, velocity, acceleration and the like.

Some of the technology for the features noted above includes skeleton modeling of the individuals in the elevator lobby 17 which is now easily processed in real-time from 3D sensors (e.g., Kinect™) for body pose estimation. Video activity recognition in particular can now reliably detect simple actions (e.g., queuing, mopping, conversing, etc.) given a large enough field of view and observation time. The video activity recognition may be achieved by probabilistic programming, markov, logic networks, deep networks and the like. Facial detection, which may be used with or without pupil tracking for gaze detection, is also commercially available along with vocal recognition devices.

The use of multiple (stand-off) cues and contextual incidences improves the responsiveness and reliability of intention recognition. Thus, use of the sensor assembly 14 and the controller 15 can lead to a powerful and reliable deduction of individual intention which will in turn lead to more responsive and reliable demand detection and better utilization of the equipment. That is, the systems and method described herein will avoid false call and provide for a better user experience.

In accordance with further embodiments, while the description provided above is generally directed towards deciding to call an elevator when there appears to people in the elevator lobby who intend to board hence an elevator needs to be called, the systems and methods could also be applied in destination entry systems. In a destination entry system, a person enters their destination floor at a kiosk at an origin floor and is assigned a specific elevator (e.g., elevator C). The person then boards elevator C and is not required to press a button for their destination while inside the car since the elevator system already knows the destination floors of all passengers inside the car. An issue for this type of user interface is knowing how many people are waiting for their elevators. This is because each elevator car has a finite capacity (e.g., 12 passengers) and if the sensor assembly 14 recognizes that that there are already 12 people waiting in front of elevator C, the controller 15 should no longer assign more calls to elevator C.

Ideally, for a destination entry system and for other similar systems, each passenger would enter a call individually. However, in practice, when a group of people (e.g., a family or a group of colleagues who work on the same floor) use such a system, only one person enters a call on behalf of the group. In these cases, the role of the sensor assembly 14 is not to merely to determine that someone in the elevator lobby 17 intends to board some elevator but rather that five passengers appear to be waiting for elevator A, eight passengers appear to be waiting for elevator B, zero passengers appear to be waiting for elevator C, etc. For this type of user interface, the intent being deduced is regarding which elevator people are waiting for and not whether or not they intend to take some elevator.

While the disclosure is provided in detail in connection with only a limited number of embodiments, it should be readily understood that the disclosure is not limited to such disclosed embodiments. Rather, the disclosure can be modified to incorporate any number of variations, alterations, substitutions or equivalent arrangements not heretofore described, but which are commensurate with the spirit and scope of the disclosure. Additionally, while various embodiments of the disclosure have been described, it is to be understood that the exemplary embodiment(s) may include only some of the described exemplary aspects. Accordingly, the disclosure is not to be seen as limited by the foregoing description, but is only limited by the scope of the appended claims.

What is claimed is:

1. An elevator system, comprising:

a sensor assembly disposable in or proximate to an elevator lobby and configured to deduce intents of individuals in the elevator lobby to board one of one or more elevators and to issue a call signal in response to deducing the intents of the individuals to board the one of the elevators; and a controller configured to receive the call signal issued by the sensor assembly and to assign one or more of the elevators to serve the call signal at the elevator lobby, wherein the sensor assembly is configured to sense one or more of multiple cues and contextual incidences relating to each individual and a group of the individuals and to compare the one or more of multiple cues and contextual incidences with historical data to deduce the intents.

2. The elevator system according to claim 1, wherein the sensor assembly is configured to sense one or more of multiple cues and contextual incidences relating to the individuals.

3. The elevator system according to claim 1, wherein the sensor assembly is configured to sense one or more of multiple cues and contextual incidences relating to each individual and the group of the individuals and to compare the one or more of multiple cues and contextual incidences with historical data to deduce the intents.

4. The elevator system according to claim 1, wherein the sensor assembly is configured to sense the individuals' body orientations, head poses, gaze directions, motion histories, clustering with other individuals and vocals to deduce the intents.

5. The elevator system according to claim 1, wherein the sensor assembly is configured to sense the individuals' body orientation, head poses, gaze directions, motion histories, clustering with other individuals and vocals and to compare the individuals' body orientations, head poses, gaze directions, motion histories, clustering with other individuals, elevator data and vocals with historical data to deduce the intents.

6. The elevator system according to claim 1, wherein the sensor assembly comprises a depth sensor.

7. An elevator system, comprising:

a sensor assembly disposable in or proximate to an elevator lobby and configured to deduce an intent of at least one of multiple individuals in the elevator lobby to board a particular one of multiple elevators and to issue a call signal accordingly; and a controller configured to receive the call signal issued by the sensor assembly and to assign the particular one or more of the multiple elevators to serve the call signal at the elevator lobby, wherein the sensor assembly is configured to sense one or more of multiple cues and contextual incidences relating to each of the multiple individuals and a grouping thereof and to compare the one or more of multiple cues and contextual incidences with historical data to deduce the intent.

8. The elevator system according to claim 7, wherein the sensor assembly is configured to sense one or more of multiple cues and contextual incidences relating to each of the multiple individuals and a grouping thereof.

9. The elevator system according to claim 7, wherein the sensor assembly is further configured to sense a group behavior of the multiple individuals and to compare the group behavior with historical data to deduce the intent.

10. The elevator system according to claim 7, wherein the sensor assembly is configured to sense one or more of each individual's body orientation, head pose, gaze direction, motion history, clustering with other individuals and vocals to deduce the intent.

11. The elevator system according to claim 7, wherein the sensor assembly is configured to sense one or more of each individual's body orientation, head pose, gaze direction, motion history, clustering with other individuals and vocals and to compare the one or more of the individual's body orientation, head pose, gaze direction, motion history, clustering with other individuals and vocals with historical data to deduce the intent.

12. The elevator system according to claim 11, wherein the sensor assembly is further configured to sense a group behavior of the multiple individuals and to compare the group behavior with historical data to deduce the intent.

13. The elevator system according to claim 7, wherein the sensor assembly comprises a depth sensor.

14. A method of operating a sensor assembly of an elevator system, the method comprising:

deducing intents of individuals and a grouping of the individuals in an elevator lobby to board an elevator of the elevator system; and issuing a call signal for bringing the elevator to the elevator lobby in accordance with the intents of the individuals and the grouping of the individuals to board the elevator being deduced, wherein the deducing comprises sensing one or more of multiple cues and contextual incidences relating to each individual and to the group of the individuals.

15. The method according to claim 14, wherein the deducing comprises:

sensing one or more of multiple cues and contextual incidences relating to the each individual; and comparing the one or more of multiple cues and contextual incidences with historical data.

16. The method according to claim 14, wherein the deducing comprises sensing the individuals' body orientations, head poses, gaze directions, motion histories, clustering with other individuals, elevator data and vocals.

17. The method according to claim 14, wherein the deducing comprises:

sensing the individuals' body orientations, head poses, gaze directions, motion histories, clustering with other individuals, elevator data and vocals; and comparing the individuals' body orientations, head poses, gaze directions, motion histories, clustering with other individuals, elevator data and vocals with historical data.

* * * * *